United States Patent [19]

Laks

[11] Patent Number: 4,988,545

[45] Date of Patent: Jan. 29, 1991

[54] METHOD FOR TREATING WOOD AGAINST FUNGAL ATTACK

[75] Inventor: Peter E. Laks, Hancock, Mich.

[73] Assignee: Board of Control of Michigan Technological University, Houghton, Mich.

[21] Appl. No.: 394,802

[22] Filed: Aug. 17, 1989

[51] Int. Cl.[5] ..... B05D 1/18

[52] U.S. Cl. ..... 427/440; 106/15.05; 428/541; 428/907

[58] Field of Search ..... 106/15.05; 427/440; 428/541, 907

[56] References Cited

U.S. PATENT DOCUMENTS

| | | | |
|---|---|---|---|
| 1,010,122 | 11/1911 | DeCew | 428/541 |
| 1,057,211 | 3/1913 | Baekeland | 428/541 |
| 4,220,688 | 9/1980 | Mitchell et al. | 428/541 |
| 4,413,023 | 11/1983 | Chow | 427/456 |
| 4,663,367 | 5/1987 | Navratil et al. | 166/295 |
| 4,732,817 | 3/1988 | Lotz et al. | 428/541 |
| 4,760,088 | 7/1988 | Laks | 514/456 |

*Primary Examiner*—Norman Morgenstern
*Assistant Examiner*—Terry J. Owens
*Attorney, Agent, or Firm*—Michael, Best & Friedrich

[57] ABSTRACT

Complexes of sulfited tannin extract and a copper(II) ion effectively protect wood against fungal attack. The complex can be impregnated into wood in a single step treatment using a water/organic solvent system, or formed in situ by treating the wood with an aqueous solution containing the extract and subsequently treating the wood with an aqueous solution containing a copper (II) salt.

7 Claims, No Drawings

METHOD FOR TREATING WOOD AGAINST FUNGAL ATTACK

BACKGROUND OF THE INVENTION

This invention relates to wood preservation and, more particularly, to wood preservatives based on condensed tannins and the use of same to protect wood against deterioration caused by weathering, fungal attack, etc.

The use of tannin-containing extracts from various woods and bark as wood preservatives is well known. For instance, Lotz et al U.S. Pat. No. 4,732,817 discloses impregnating wood with an aqueous solution containing a tannin extract from a species known to have a desirable resistance to weathering, fungal attack, etc., by itself or in combination with a metal salt, such as cupric chloride or cupric sulfate. In order to prevent leaching of the tannin extract and/or the extract and metallic salt combination, the wood must be subsequently impregnated with a non-ionic surfactant which serves as a fixative material.

The Background of the Invention section of Lotz et al U.S. Pat. No. 4,732,817 describes several other prior techniques for preserving wood with some form of tannin and/or tannic acid. In particular, Mitchell et al U.S. Pat. No. 4,220,688 discloses first impregnating wood with a tannic acid-ethanol solution following by impregnation with an aqueous solution of a metal salt, such as ferric chloride, which complexes with the tannin and the wood. Chow U.S. Pat. No. 4,413,023 discloses wetting the surface of wood with an extract from a decay resistant species of wood. The extract is obtained with acetone, methanol, ethanol or an aqueous alkaline solution such as a borax solution.

Laks. U.S. Pat. No. 4,760,088 discloses the use of chemically modified (i.e., sulfide derivatives) of condensed tannins and copper complexes of such derivatives as wood preservatives.

Applicant has found that the combination of a specific tannin extract, (sulfited tannin extract) which is not effective against fungal attack by itself and a copper (II) salt capable of complexing with such extract is an effective wood preservative.

SUMMARY OF THE INVENTION

An object of the invention is to provide a method for treating wood for protection against fungal attack.

Another object of the invention is to provide such a method which can be applied in a single step treatment.

A further object of the invention is to provide a wood preservative which can be applied in a single step and provide protection against fungal attack.

Other objects, aspects and advantages of the invention will become apparent upon reviewing the following detailed description and the appended claims.

The invention provides a method for treating wood against fungal attack by impregnating the wood with an effective amount of a liquid preservative including a sulfited tannin extract, such as a sulfited conifer tree bark extract, complexed with a copper (II) ion.

In one embodiment, the extract and the copper (II) ion are first complexed in an aqueous solution containing the complex and a solublizing amount of a solvent and the resulting complex-containing solution is used to impregnate the wood to be treated.

In another embodiment, the complex is formed in situ by first treating the wood with an aqueous solution of the extract and then with an aqueous solution of a copper (II) salt.

The wood preservative provided by the invention is particularly effective against attack by soft rot and white rot fungi.

DETAILED DESCRIPTION

As used herein, the term "sulfited tannin extract" means condensed tannin obtained from a wide variety of plant tissue by extraction with a conventional aqueous sulfite extracting solution, for example, an aqueous solution containing about 4% sodium bisulfite and about 0.4% sodium bicarbonate. The sulfited tannin preferably is extracted from plant tissues having a high tannin content.

Suitable plant tissues include the bark from conifers, such as pines (e.g., loblolly pine, Southern pine, red pine, ponderosa pine and jack Pine), hemlock, Douglas fir, spruce, cedar and juniper, and hardwoods, such as chestnut, eucalyptus, quebracho and chestnut oak. Agricultural residues, such as pecan and walnut pitch, also can be used. Higher concentrations of condensed tannin usually are found in the bark of conifers and this is the presently preferred source.

The tannin source preferably is comminuted into finely divided form so that a large surface area is contacted by the sulfite extracting solution. To maximize yield, the extraction can be carried out at a temperature of about 100° C. for about 15 minutes to about 2 hours. The solution containing the sulfited tannin extract is filtered to remove particulates and the extract preferably is reduced to powder form in a conventional manner such as by evaporation or by distillation to remove water followed by spray drying. The resulting sulfited tannin extract is water soluble.

The copper (II) salt combined with the sulfited tannin extract preferably is water soluble to facilitate impregnation. Suitable copper (II) salts include cupric chloride and cupric sulfate.

The sulfited tannin extract/Cu(II) ion complex can be formed (a) by admixing the extract and a copper(II) salt in solution or (b) in situ by a two step process in which the wood is first impregnated with an aqueous solution containing the extract and then impregnated with an aqueous solution containing the copper (II) salt.

A single step treatment using the complex is preferred because of reduced treatment costs. The sulfited tannin extract/Cu(II) ion complex is not readily soluble in water. To form the complex, the extract and salt can be admixed in an aqueous solution containing a sufficient amount of a suitable solvent to solublize the complex. Suitable solvents include water miscible organic solvents, such as methanol, ethanol, acetone, tetrahydrofuran and the like. As a guide, an ethanol/water (1:1 by volume) solution is suitable for formation of the complex and also as a treatment solution.

The proportions of the sulfited tannin extract and the copper (II) salt are selected to provide an amount of complex retained in the wood after treatment which is effective against fungal attack. Generally, the molar ratio of flavonoid units in the extract to copper salt for formation of the complex should be about 1:1 to about 2:1 and the concentration of the complex in the treatment solution should be about 0.5 to about 4, preferably about 1 to about 2.5 weight %, based on the total weight of the solution. Generally, the retention of copper in the treated wood should be about 0.08 to about 0.15 pound per cubic foot.

Some wood-decay fungi are known to be tolerant to copper-based wood preservatives. To control such fungi, it may be necessary to add an appropriate co-biocide, such as Bardac 22, chlorothalonil or Amical 48, to the sulfited tannin/copper system.

The impregnation of the wood to be treated can be carried out by any of a variety of conventional techniques used for wood preservation. For example, the complex-containing solution can be applied to the wood by a dip, spray or brush-on treatment or forced into the wood by subjecting it to an elevated pressure and at ambient or an elevated temperature in an autoclave or the like. The time, temperature and pressure used depends upon the type, size and surface area of the wood to be treated and the dept of penetration desired.

When the complex is formed in situ, the concentration of the sulfited tannin extract in the first impregnation solution is such that the amount of sulfited tannin retained in the wood is sufficient for in situ formation of an effective amount of the sulfited tannin extract/Cu(II) ion complex. On the other hand, the solution should be dilute enough to facilitate penetration into the wood during impregnation. Generally, the concentration of the sulfited tannin extract can be about 0.5 to about 5, preferably about 1 to about 2.5 weight %, based on the total weight of the solution.

After drying, the partially treated wood is impregnated with an aqueous solution of the copper (II) salt in a similar manner. The concentration of the copper (II) salt in the second impregnation solution is such that the amount of the salt penetrating into the wood is sufficient to react with the retained sulfited tannin extract to form an effective amount of the complex. Generally, the concentration of the copper (II) salt is about 0.1 to about 1.5, preferably about 0.25 to about 0.65 weight %, based on the total weight of the solution.

Without further elaboration, it is believed that one skilled in the art, using the preceding description, can utilize the present invention to its fullest extent. The following examples are presented to exemplify embodiments of the invention and should not be construed as limitations thereof.

EXAMPLE 1

Tannin extracts were prepared from loblolly pine bark obtained from logs which had been attacked by southern pine beetles. The bark was dried and ground to a fine particle size. One portion of the ground bark was sulfite extracted with an aqueous solution containing 4 wt. % sodium bisulfite and 0.4 wt. % sodium bicarbonate (based on dry bark weight) at a liquor to bark ratio of 7:1 for 2 hours at 90°-100° C., taking about 1 hour to reach that temperature. The extract liquor was filtered to remove particulates and dried in a vacuum-pan evaporator. Another portion of the bark was extracted with an acetone/water (1:1 by volume) solution at a liquor to bark ratio of 9:1 for 2 hours at 50° C. The extract liquor was filtered to remove particulates, acetone was removed under reduced pressure, and then dried.

Wood treatment solutions containing the bark extracts and a water soluble copper salt (cupric chloride) at different concentrations were formulated in water Complexes of the bark extracts and copper (II) salt were found to be insoluble in water. This is an advantage after being impregnated into wood because the complex is not prone to leaching out.

As one approach for simplifying the insolubility difficulties, the complexes were formed in situ. That is, sample blocks of wood were first impregnated with an aqueous solution containing the bark extracts, allowed to dry and then impregnated with an aqueous solution of cupric chloride. The wood blocks were impregnated with these solutions by submerging them into a beaker containing the solution, exposing them to a partial vacuum of 25 mm Hg for 30 minutes and then pressurizing them at 70–90 psi for 40 minutes. One set of blocks was left untreated for a control and another set was treated with an aqueous solution of cupric chloride. The treated wood blocks were sealed in a plastic bag for 7 days and then air dried for an additional 7 days.

The thus treated wood blocks were evaluated against wood decay fungi in accordance with ASTM D1413-81:Standard Method of Testing Wood Preservatives by Laboratory Soil Block Cultures. Sets of five 19 mm birch blocks impregnated with different preservative were exposed to actively growing cultures of *Coriolus versicolor* (white rot, ATCC 12679). After a three month incubation period, the test blocks were removed from the jars and then air dried, oven dried and re-weighed. Preservative Performance was evaluated by the average percent weight loss calculated for each block set.

The formulations were also evaluated for effectiveness against soft rot fungi using an unsterile soil or "soil burial" test which is a modification of ASTM D1413. Treated blocks were incubated in jars of unsterile soil moistened to the appropriate level to encourage the development of naturally-occurring soft rot fungi. The soil jars were prepared with a soil moisture content adjusted to 100% of the water holding capacity. Five sets of birch blocks (19 mm cubes) impregnated with the formulations were treated and prepared in accordance with ASTM D1413, except they were not sterilized. One set of block was left untreated for a control and another set was treated with an aqueous solution of cupric chloride.

The blocks were added to the jars by pushing them into the soil, lengthwise, until completely covered and then incubated for three months. Preservative performance was evaluated by the average percent loss of each block set.

The results from these tests are summarized below in Tables I and II, respectively:

TABLE I

EFFECTIVENESS ON WHITE ROT FUNGUS CORIOLUS VERSICOLOR

| | Solution Composition, wt. % | | Mean Retention[1] kg/cm² | | |
|---|---|---|---|---|---|
| Treatment | Organic Component | $CuCl_2$ | Organic Component | Cu | Mean Weight Loss, %[1] |
| Control (untreated) | | | | | 50 |
| $CuCl_2$ | | 1.0 | | 2.7 | 6.27 |
| | | 2.0 | | 5.3 | 49.3 |
| Acetone | 2.0 | | 14.35 | | 59.1 |
| extract | 4.0 | | 28.34 | | 65.4 |
| Sulfite | 2.0 | | 14.70 | | 63.2 |
| extract | 4.0 | | 29.48 | | 65.3 |
| Acetone | 2.0 | 1.0 | 14.23 | 2.6 | 18.5 |
| extract+ $CuCl_2$ | 4.0 | 2.0 | 29.38 | 5.1 | 11.5 |
| Sulfite | 2.0 | 1.0 | 14.28 | 2.6 | 15.2 |
| extract | 4.0 | 2.0 | 28.71 | 5.0 | 5.0 |

TABLE I-continued

| EFFECTIVENESS ON WHITE ROT FUNGUS CORIOLUS VERSICOLOR | | | | | |
|---|---|---|---|---|---|
| | Solution Composition, wt. % | | Mean Retention(1) kg/cm² | | |
| Treatment | Organic Component | $CuCl_2$ | Organic Component | Cu | Mean Weight Loss, %(1) |
| $CuCl_2$ | | | | | |

Notes:
(1)Average of 5 replicates

TABLE II

| EFFECTIVENESS ON SOFT ROT FUNGUS | | | | | |
|---|---|---|---|---|---|
| | Solution Composition, wt. % | | Mean Retention(1) kg/cm² | | |
| Treatment | Organic Component | $CuCl_2$ | Organic Component | Cu | Mean Weight Loss, %(1) |
| Control (untreated) | | | | | 11.2 |
| $CuCl_2$ | | 1.0 | | 2.7 | 3.3 |
| | | 2.0 | | 4.7 | 2.4 |
| Acetone | 2.0 | | 12.69 | | 10.8 |
| extract | 4.0 | | 26.35 | | 10.5 |
| Sulfite | 2.0 | | 12.82 | | 12.0 |
| extract | 4.0 | | 26.17 | | 12.4 |
| Acetone | 2.0 | 1.0 | 12.49 | 2.3 | 4.1 |
| extract + $CuCl_2$ | 4.0 | 2.0 | 25.02 | 4.1 | 2.0 |
| Sulfite | 2.0 | 1.0 | 12.89 | 2.3 | 1.3 |
| extract + $CuCl_2$ | 4.0 | 2.0 | 26.18 | 4.5 | 0.4 |

Notes:
(1)Average of 5 replicates

From these test results, it can be seen that neither the sulfited tannin extract by itself nor the acetone tannin extract by itself provided significant protection against white rot or soft rot fungi at the concentrations tested. On the other hand, the combination of sulfited bark extract and cupric chloride was more effective than either cupric chloride alone or sulfited bark extract alone. Also, the combination of sulfited bark extract and cupric chloride was more effective than the combination of acetone bark extract and cupric chloride at the same retention levels, about twice as effective against the white rot fungus at the higher retention tested.

The sulfited bark extracts used in the above tests were obtained from bark obtained from trees that been killed by Southern pine beetles. As second sulfited extract was prepared in the same manner from a bark of freshly harvested pulpwood-sized loblolly pine trees. A two step treatment using this sulfited tannin extract in combination with cupric chloride provided better protection than the sulfite extract the from beetle-killed trees at all retention levels.

EXAMPLE 2

A sulfited tannin extract was prepared from loblolly pine bark in the manner described in Example 1 and admixed with cupric chloride in an ethanol/water (1:1 volume) solution to form a sulfited tannin/Cu (II) ion complex. Different concentrations of the extract and cupric chloride were used like in Example 1.

The complex-containing solutions were evaluated for efficacy as a wood preservative and found to provide protection against fungal attach comparable to that provided by the two step treatment described in Example 1 at all retention levels.

From the foregoing description, one skilled in the art can easily ascertain the essential characteristics of the invention and, without departing from the spirit and scope there of, make various changes and modifications to adapt it to various usages.

I claim:

1. A method for treating wood against fungal attack comprising:

impregnating the wood with an effective amount of a liquid preservative including a sulfited tannin extract complexed with a copper (II) ion.

2. A method according to claim 1 wherein said preservative includes an aqueous solution of said complex and in a sufficient amount of solvent to solublize said complex in water.

3. A method according to claim 1 wherein said complex is formed in situ by impregnating the wood with a first aqueous solution of said sulfited tannin extract; and subsequently impregnating the wood with a second aqueous solution containing a water soluble copper (II) salt.

4. A method according to claim 1 wherein said extract is obtained from the bark of a conifer tree.

5. A method according to claim 4 wherein said copper salt is cupric chloride or cupric sulfate.

6. A method according to claim 5 wherein the amount of said complex in said preservative is about 0.5 to about 4 weight % based on the total weight of the preservative.

7. A method according to claim 3 wherein the amount of said sulfited tannin extract in said first solution is about 0.5 to about 5 weight %, based on the total weight of said first solution, and the amount of said copper (II) salt in said second solution is about 0.1 to about 1.5 weight % based on the total weight of said second solution.

* * * * *